United States Patent [19]

Shigehara

[11] 4,010,435

[45] Mar. 1, 1977

[54] TERMINALS FOR COIL BOBBIN

[76] Inventor: Katumi Shigehara, 1729, Kashiya, Ebina, Kanagawa, Japan

[22] Filed: June 3, 1976

[21] Appl. No.: 692,434

[30] Foreign Application Priority Data

June 4, 1975 Japan ..... 50-66403
Dec. 10, 1975 Japan ..... 50-165628

[52] U.S. Cl. ..... 336/192; 29/628; 29/630 B

[51] Int. Cl.[2] ..... H01F 15/10

[58] Field of Search ..... 336/192; 339/220 C, 339/220 R, 220 T, 275 R, 275 A; 29/628, 630 B; 310/71

[56] References Cited

FOREIGN PATENTS OR APPLICATIONS 1,227,149 10/1966 Germany ..... 336/192

*Primary Examiner*—Thomas J. Kozma
*Attorney, Agent, or Firm*—Marshall & Yeasting

[57] ABSTRACT

Terminals for a coil bobbin comprising a flange plate mounted on one end of a coil bobbin and provided with notches of a number corresponding to the number of necessary terminals, an another flange plate spaced from said flange plate and provided with holes of a number corresponding to the number of necessary terminals, and terminals elements each composed of a pin formed into a substantially U-shape and pressed into between said flange plates with an extremity thereof passing through said hole.

5 Claims, 4 Drawing Figures

TERMINALS FOR COIL BOBBIN

SUMMARY OF THE INVENTION

The present invention relates to terminals for a coil bobbin.

BACKGROUND OF THE INVENTION

One of the conventional terminals mounted on a coil bobbin is composed of a pin partially deformed by pressing which is affixed by caulking in a terminal hole provided in a flange plate of a coil bobbin.

In an another conventional method the terminal pins are spacedly arranged between a pair of insulating paper tapes which are mutually adhered by an adhesive material to fix said terminal pins, and said insulating paper tapes with thus arranged terminal pins are mounted by means of an adhesive tape on the outer periphery of a coil.

The former method, however, is associated with a drawback that the terminals pins may come off from the pin holes when said pins are subjected to vibration or tension.

Also the latter method is associated with a drawback that the terminal pins cannot be easily inserted into the holes of a print circuit board etc. due to rather irregular arrangement of said pins resulting from insufficient fixation thereof, and that the considerably large exposed portions of terminals pins may result in undesirable contact with or shortcircuiting of other wirings.

OBJECT OF THE INVENTION

The present invention is to provide terminals which can be assuredly fixed on a coil bobbin and permit easy mounting on a print circuit board or the like, thus avoiding the above-mentioned drawbacks.

DESCRIPTION OF THE PREFERRED EMBODIMENTS

Figure 1:
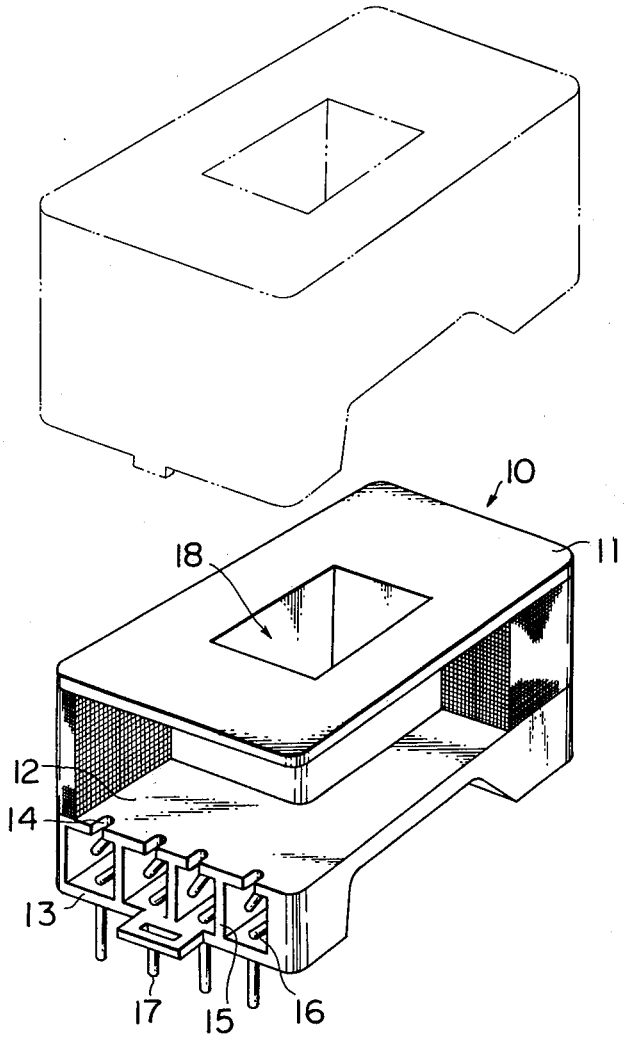
FIG. 1 is a perspective view of a coil bobbin provided with terminals of the present invention.
Figure 2:
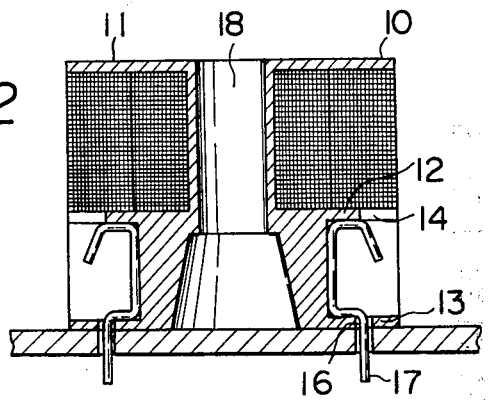
FIG. 2 is a cross sectional view of a coil bobbin provided with terminals of the present invention.

Referring to FIGS. 1 and 2 showing an embodiment of the present invention applied to a small transformer, the coil bobbin 10 composed of a plastic material for winding coils thereon consists of a rectangular tube 18 provided on both ends thereof with flange plates 11 and 12. An another flange plate 13 is provided below the flange plate 12 and connected to the coil bobbin 10. Between said flange plates 12 and 13 there are provided partitions 15 in a number corresponding to the number of required terminals. Said flange plate 12 is provided with notches 14 of a number corresponding to the number of required terminals, while said flange plate 13 is provided with holes 16 for passing pins each corresponding to said recesses 14. The terminals are composed of pins 17 which are formed into a substantially U-shape and pressed in between said flange plates 12 and 13 and of which extremities are made to pass through said holes 16. Said pins 17 are bent somewhat down-wards at the other extremities to facilitate connection of the coil wires.

Figure 3:
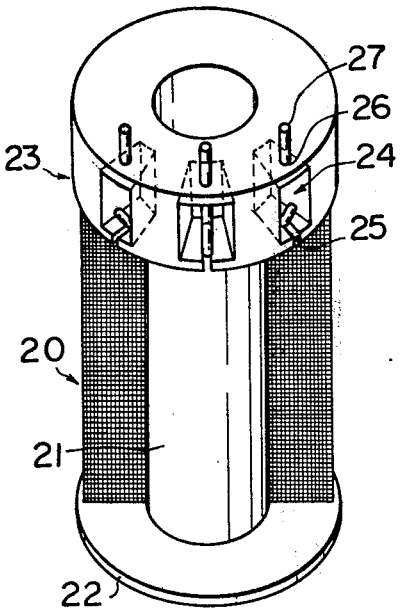
FIG. 3 is a perspective view of an another embodiment of the terminals of the present invention.

Referring to FIG. 3 showing an another embodiment of the present invention applied to a solenoid or relay, the coil body 20 is composed of a tubular portion 21 which is provided on one end thereof with a disc-shaped flange plate 23 and on the other end thereof with a cylindrical terminal mounting portion 23. Said terminal mounting portion 23 is provided with recesses 24 of a number corresponding to the number of required terminals, each of said recesses being provided with a notch 25 on the lower part thereof and a hole 26 for passing a pin on the upper part thereof. The terminals are composed of pins 27 which are formed in a substantially U-shape and pressed into said recesses 24 in such a manner that the extremities of said pins pass through said holes 26. The other extremities of pins at the notches are bent somewhat upward to facilitate connection of the coil wires.

Figure 4:
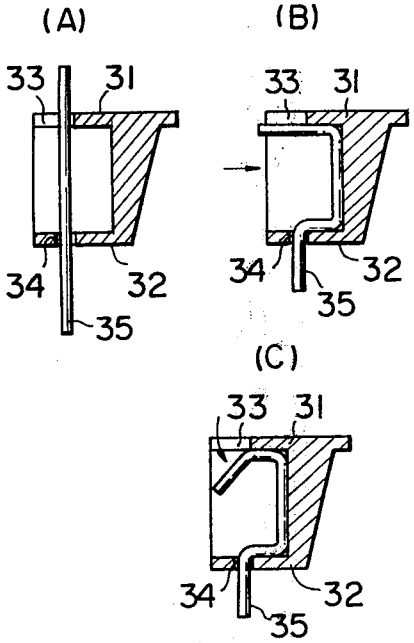
FIG. 4 is a partial cross sectional view thereof.

FIG. 4 shows the method of mounting a terminal on the coil bobbin. In FIG. 4A showing the initial state of terminal mounting, a pin 35 is placed over the notch 33 in the flange plate 31 and through the hole 34 of the another flange plate 32. FIG. 4B shows a state wherein the pin 35 is formed into a substantially U-shape between the flange plates by pressing said pin in lateral direction by means for example of a pressing machine. FIG. 4C shows a state wherein an extremity of said pin 35 is bent downwards by pressing said extremity downward in order to facilitate the connection of coil wires.

According to the present invention thus far explained, it is rendered possible to assuredly mount terminals on a coil bobbin without the danger of falling off of terminals by vibration or tension or of shortcircuiting with other circuits, and also to mount the coil in close contact with a print circuit board or the like, thus facilitating the assembly of circuitry.

What we claim are:

1. Terminals and a coil bobbin comprising a flange plate provided on one end of the tubular portion of a coil bobbin and provided with notches of a number corresponding to the number of required terminals, an another flange plate spaced from said flange plate and provided with holes for passing terminal pins of a number corresponding to the number of required terminals, and terminal elements each composed of a pin formed into a substantially U-shape and pressed in between said flange plates with an end passing through said hole.

2. Terminals and a coil bobbin according to the claim 1 wherein said coil bobbin is a coil bobbin for a small transformer.

3. Terminals and a coil bobbin according to the claim 1 wherein said coil bobbin is a coil bobbin for a solenoid.

4. Terminals and a coil bobbin according to the claim 1 wherein said coil bobbin is a coil bobbin for a relay.

5. A method for producing terminals and a coil bobbin comprising the steps of placing pins respectively on the notches of a number corresponding to the number of required terminals provided on a flange plate provided on one end of a tubular portion of a coil bobbin and further respectively through holes of a number corresponding to number of required terminals provided on an another flange plate spaced from aforementioned flange plate, of forming said pins into a substantially lateral U-shape by means of a pressing machine, and of inwardly bending a part of said pins where the coil lead wires are to be connected.

* * * * *